US005729838A

United States Patent [19]

Schweizer

[11] Patent Number: 5,729,838

[45] Date of Patent: Mar. 24, 1998

[54] PROTECTIVE LAYER FOR TOILET SEATS

[75] Inventor: Paul Schweizer, Unterengstringen, Switzerland

[73] Assignee: Limark AG, Bern, Switzerland

[21] Appl. No.: 547,022

[22] Filed: Oct. 23, 1995

Related U.S. Application Data

[63] Continuation of Ser. No. 232,004, filed as PCT/CH93/00213, Aug. 30, 1993, published as WO94/05194, Mar. 17, 1994, abandoned.

[30] Foreign Application Priority Data

Aug. 31, 1992 [CH] Switzerland ..... 2733/92

[51] Int. Cl.[6] ..... A47K 13/16

[52] U.S. Cl. ..... 4/245.8

[58] Field of Search ..... 4/245.4, 245.5, 4/245.8, 245.1, 245.3, 245.6, 245.7, 245.9

[56] References Cited

U.S. PATENT DOCUMENTS

| | | | |
|---|---|---|---|
| 1,155,260 | 9/1915 | Meyer . | |
| 4,850,061 | 7/1989 | Engel . | |
| 4,887,321 | 12/1989 | MacLean | 4/245.5 |

FOREIGN PATENT DOCUMENTS

| | | | |
|---|---|---|---|
| 0097133 | 12/1983 | European Pat. Off. . | |
| 0331631 | 9/1989 | European Pat. Off. . | |
| 229439 | 12/1910 | Germany . | |
| 659249 | 4/1938 | Germany . | |
| 2501350 | 4/1979 | Germany . | |
| 3251219 | 11/1991 | Japan | 4/245.8 |
| 308167 | 3/1929 | United Kingdom . | |
| 2097832 | 11/1982 | United Kingdom . | |

*Primary Examiner*—Charles E. Phillips

*Attorney, Agent, or Firm*—Sughrue, Mion, Zinn, Macpeak & Seas, PLLC

[57] ABSTRACT

The protective layer exhibits an oblong web (1), which is to be laid on the surface of the seat, and is made of a thin and flexible film, for example tissue paper. The web (1) is shrunk in its longitudinal direction into a package and provided with a wrapper (3) that can be torn open. The wrapper consists of a separately produced tape (3), which envelops the shrunk web (1) at right angles to the longitudinal direction. For use, the wrapper is torn open at the tab members (A, B) and the web (1) expands, whereby an edge (1*b*) changes automatically into a position projecting from a seat region (1*a*).

10 Claims, 4 Drawing Sheets

PROTECTIVE LAYER FOR TOILET SEATS

This is a Continuation of Application Ser. No. 08/232,004, filed as PCT/CH93/00213 Aug. 30, 1993 published as WO94/05194 Mar. 17, 1994 now abandoned.

The invention relates to a protective layer for toilet seats, comprising an oblong web, which is to be laid on the surface of the seat and is made of a thin and flexible film, said web exhibiting a folding line extending in the longitudinal direction and around which one edge of the web is laid by 180°; and the web exhibits two free ends and is housed in an envelop.

A protective layer of this class is known from the EP-B-O 331 631. It can be applied in a simple manner and with few manipulations on essentially all customary toilet seats. When the web is unfolded, the edge changes into a position projecting about 90°, a feature that simplifies laying and holding the protective layer on the surface of the seat.

The task that the inventor has set for himself is to provide a protective layer of said class that can also be laid with ease, but is simpler to produce. In addition, the protective layer is to exhibit less volume in the packaged state.

The problem with a protective layer forming a class is solved according to the characterizing features of claims 1 and 7. According to one embodiment of the invention, the web is shrunk in the longitudinal direction. It has been demonstrated surprisingly that a web of tissue paper having a length of about 1 meter can be compressed through shrinkage into a packet, having a width ranging from 2 to 2.5 cm and a thickness ranging from 4 to 5 mm. Such a shrinkage can be carried out comparatively readily by machine. In order for the shrunk package to retain the shrunk shape and yet be unfolded effortlessly, steam can be fed to the web during the shrinking process. The result is a superficial adhesion of the paper, which can be detached, however, quite easily by pulling the web apart. The folds produced by the shrinking process are comparatively narrow and irregular. Preferably the protective layer is made of tissue paper. The unfolding and laying of the protective layer is similar to the process for the aforementioned, prior art layer. When the protective layer according to the invention is unfolded, the edge also changes automatically into a projecting position. It has also been demonstrated that, owing to the high flexibility of the shrunk web, said web is, on the whole, simple and pleasant to manipulate. Thus, despite the significantly simpler production and smaller volume, the protective layer according to the invention can also be laid on a toilet seat by clumsy users. The adaptation to different toilet seats is similarly guaranteed.

In one modification of this class of protective layer the edge is folded corresponding to the other section of the web and is attached to this other part. Compared to the aforementioned prior art protective layer, the folding process is dramatically simpler here. The folding process can be, for example, a fanfold. Compared to the prior art protective layer, this design exhibits the significant advantage that the folded package is more compact, since multiple folding operations are avoided. The rectangular, dense package can be packaged quite compactly, an important point for a product, which is provided especially for use on the road.

Other advantageous modifications and features follow from the dependent claims and the subsequent description.

Embodiments of the invention are explained in detail with reference to the drawings in the following.

Figure 1:
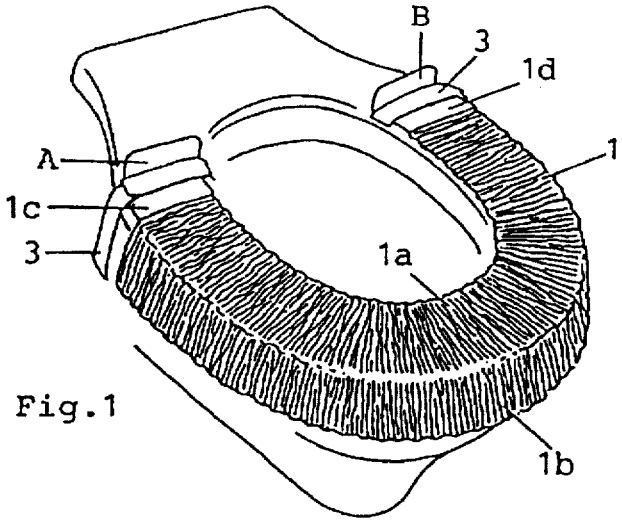
FIG. 1 is a perspective view of a protective layer laid on a toilet seat, according to a first embodiment.
Figure 7:
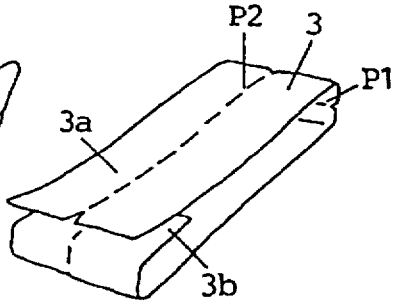
FIG. 7 is a perspective view of an envelope.
Figure 3:
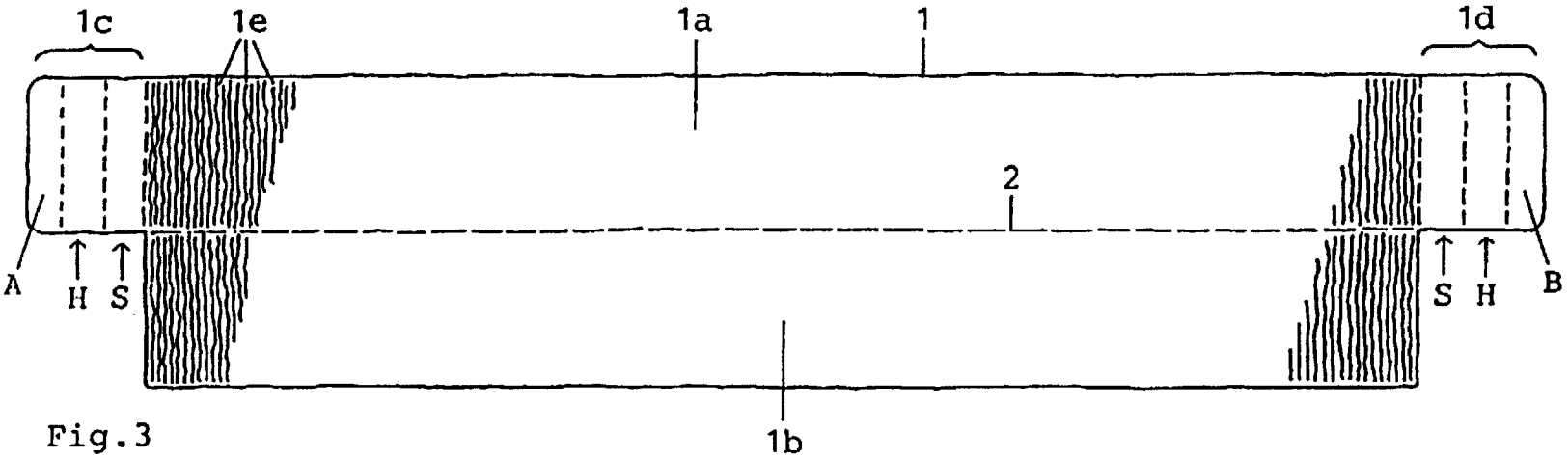
FIG. 3 is a top view of a web of paper with a wide, longitudinally folded center section, which, tightly shrunk, forms the actual package, and which exhibits a flat, unshrunk flap at both ends.

A protective layer according to the invention comprises the web 1, shown in FIG. 3, and the envelop 3, shown in FIG. 7. In FIG. 1 the web 1 is unfolded and laid on the toilet seat with toilet lid. To affix the web 1, the ends of said web exhibit tabs 1*c* and 1*d*, to each of which an adhesive strip H provided with adhesive is applied to the underside. Directly next to the adhesive strip H there is an adhesive protective strip S, bordered by the adjacent adhesive strip in the folded state. The protective adhesive strips S guarantee that, after opening the envelop, the adhesive strips H exist unconsumed and can affix the protective layer on the toilet seat, as explained below.

It is now important that the web 1 between the tabs 1*c* and 1*d* be shrunk overall and uniformly and that a folding line 2 extend in the longitudinal direction over the entire shrunk region. The folding line 2 divides the shrunk region into one edge 1*b* and a seat region 1*a*. The edge 1*b* and the seat region 1*a* have preferably the same width and also the same length.

The comparatively narrow, but irregularly shrunk folds 1*e* produced by the shrinking process extend in essence at right angles to the longitudinal direction of the web. These shrunk folds 1*e* impart to the web 1 high flexibility. The web 1, which is straight in the unfolded and unstressed state, can be adapted in essence to any arbitrarily shaped toilet lid owing to the web's flexibility. In addition, the shrinking process allows a web 1 having an original length of 1 meter, for example, to compress to a package having a width ranging from about 2 to 2.5 cm. The web 1 is made preferably of thin tissue paper, which is comparatively tear resistant and which dissolves rapidly and safely in water. The shrinking process can take place in a narrow channel having a V-shaped cross section. The web, which is also inserted in a V-shape into the channel, is preferably pushed from both ends with suitable pressure against the center of the channel. The suitable pressure can be determined empirically. To form the tabs 1*c* and 1*d*, the corresponding end regions of the web 1 are not shrunk, but rather folded twice.

So that the compressed web retains permanently the new shape, some hot steam is fed to said web either during or after the shrinking process. The result is a superficial adhesion of the adjacent regions, which can be dissolved again, however, with little effort.

Figure 5:
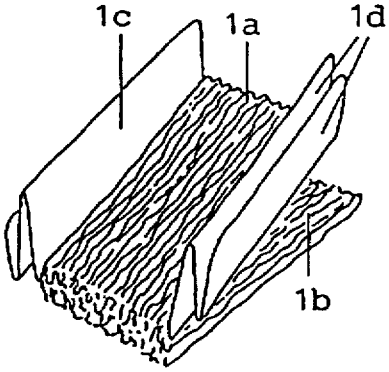
FIG. 5 is a perspective view of a partially unfolded protective layer, according to the first embodiment.
Figure 6:
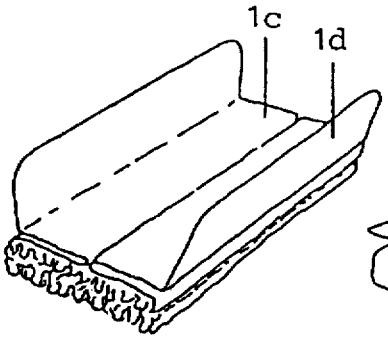
FIG. 6 is a perspective view of a protective layer, prior to affixing the envelope.

FIGS. 5 to 8 show the packaging process of the shrunk web. FIG. 5 depicts the shrunk web 1 in essence directly after the shrinking process. As one can see, the two end tabs 1*c* and 1*d* are folded twice at right angles to the longitudinal direction of the web 1. These end tabs are folded over inwardly and the edge 1*b* is folded together with the seat region 1*a*. The result is the configuration shown in FIG. 6. At this stage a tape 3, shown in FIG. 7, is laid at right angles to the longitudinal direction of the web around said configuration; and said tape is closed, for example, by cementing together the overlapping ends 3*a* and 3*b*. In so doing, the tape 3 can be cemented on the inside with the tabs 1*c* and 1*d*. At each tab 1*c* or 1*d* folded thus, the adhesive strip H rests with the adhering side against the adhesive protective strip S, thus also fixing in position the protective layer in the packaged state. (A two-sided adhesive tape (not shown here) can be applied as the adhesive agent, for example, to the adhesive strip H. Yet, other adhesive means are also possible here.

Figure 2:
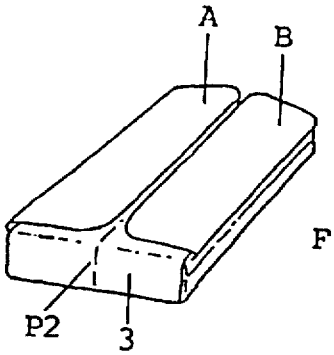
FIG. 2 is a perspective view of the same protective layer, tightly folded, in a closed envelope.
Figure 8:
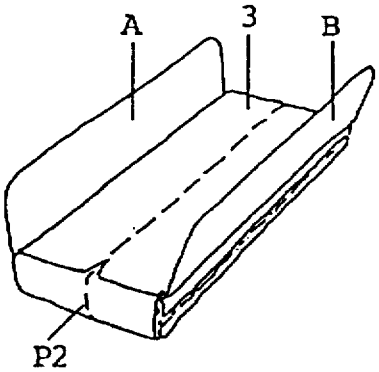
FIG. 8 is a perspective view of a protective layer, which is packaged ready for use (paper web FIG. 6+envelope FIG. 7).

Finally, in the arrangement according to FIG. 8, projecting tab members A and B are folded over inwardly by 90°. These tab members A and B are not affixed and can be grasped quite easily by hand in order to unfold the protective layer. FIG. 2 shows the resulting package.

To unfold the protective layer, the tab members A and B are grasped individually, as aforementioned, by hand; and they are pulled in opposite directions in the longitudinal directions of the web 1. In so doing, a perforation P1 of the tape 3 tears first and then a perforation P2 extending at, right angles thereto. At about the same time the adhesive strips H detach from the adhesive protective strips S. At this stage the web 1 can unfold to the desired length with little pull force and can be laid over the toilet lid from the front. The two separate parts of the tape 3 remain at the tabs 1*c* and 1*d*, as shown in FIG. 1.

Figure 4:
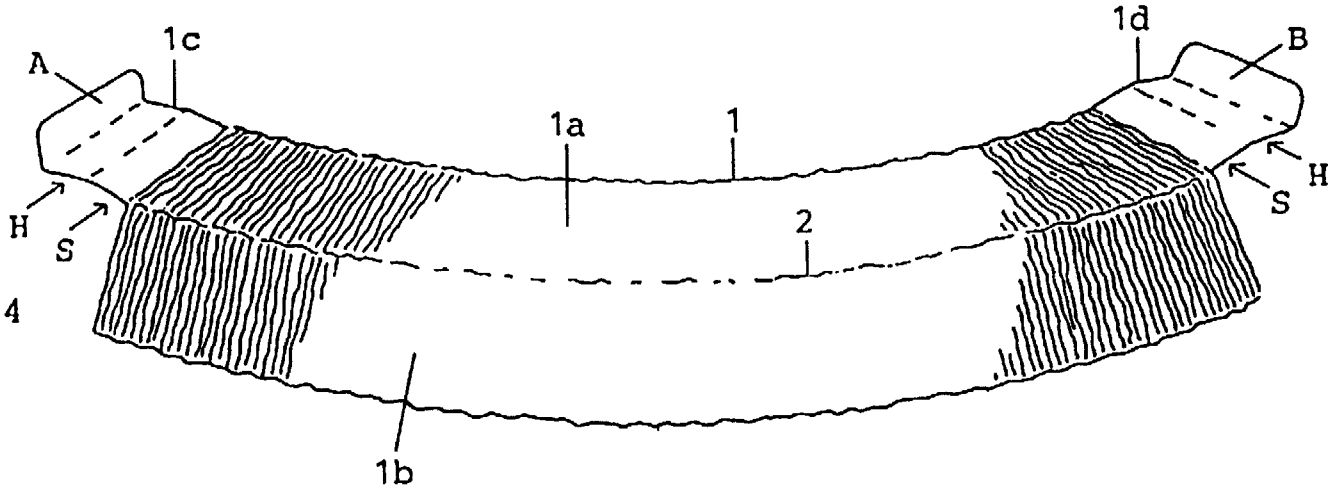
FIG. 4 is a perspective view of a partially unfolded protective layer, according to the first embodiment.
Figure 9:
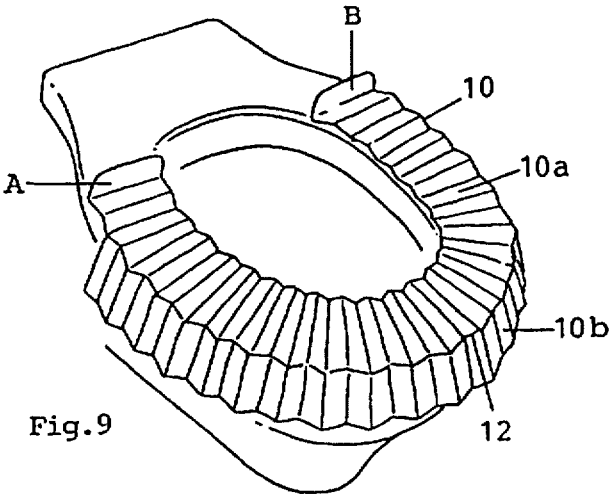
FIG. 9 is a perspective view of an unfolded web of a protective layer, according to one modification.

It has been proven now that, when the web 1 is unfolded, the edge 1*b* detaches automatically from the seat region 1*a* and changes into the position shown in FIG. 4. Thus, the unfolded web exhibits a V-shaped cross section. This feature is important now in order to apply the protective layer in a simple and reliable manner. When the protective layer is laid on the toilet lid, the tab members A and B may not be let loose. If the web 1 is laid on the toilet lid, the only requirement for affixing the tabs 1*c* and 1*d* to the toilet lid is to press lightly on the adhesive strips H.

FIGS. 9 to 15 depict a modification of the protective layer, which can also be produced in a comparatively simple manner. Said protective layer also exhibits a web 10, which is folded according to FIG. 11 and is folded around a folding line 12 in the longitudinal direction. A seat region 10*a* exhibits alternatingly upper folding lines F1 and bottom folding lines F2. They change at the folding line 12 into folding lines directed in the opposite direction. Thus, at the folding line 12 a folding line F1 changes into a folding line F2 and vice verse. This folding procedure can be readily produced by folding together a flat web 10 of tissue paper around the straight folding line 12 and by providing a fanfold beginning at one end.

Figure 10:
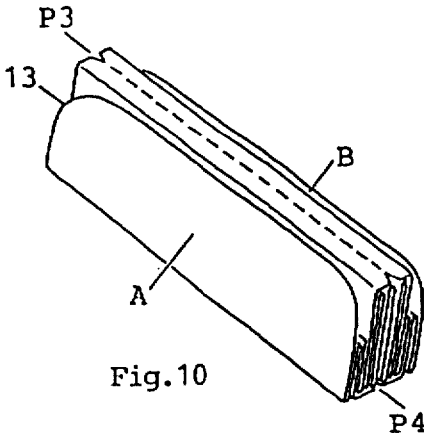
FIG. 10 is a perspective view of a protective layer, which packaged ready for use, according to the modification.
Figure 12:
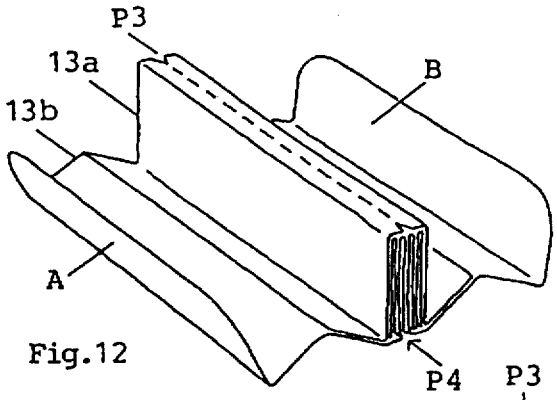
FIG. 12 is a perspective view of a protective layer, which is packaged ready for use, according to the modification, with laterally unfolded flaps, prior to tearing open the closed envelope.
Figure 15:
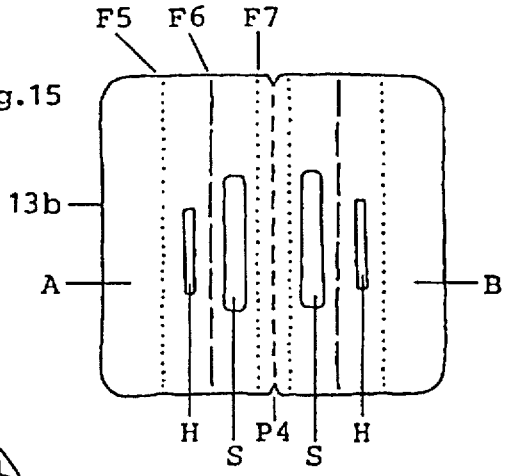
FIG. 14 and FIG. 15 are views of a section of the wrapper.
Figure 14:
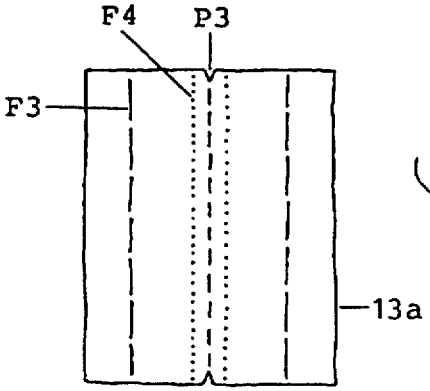
Figure 13:
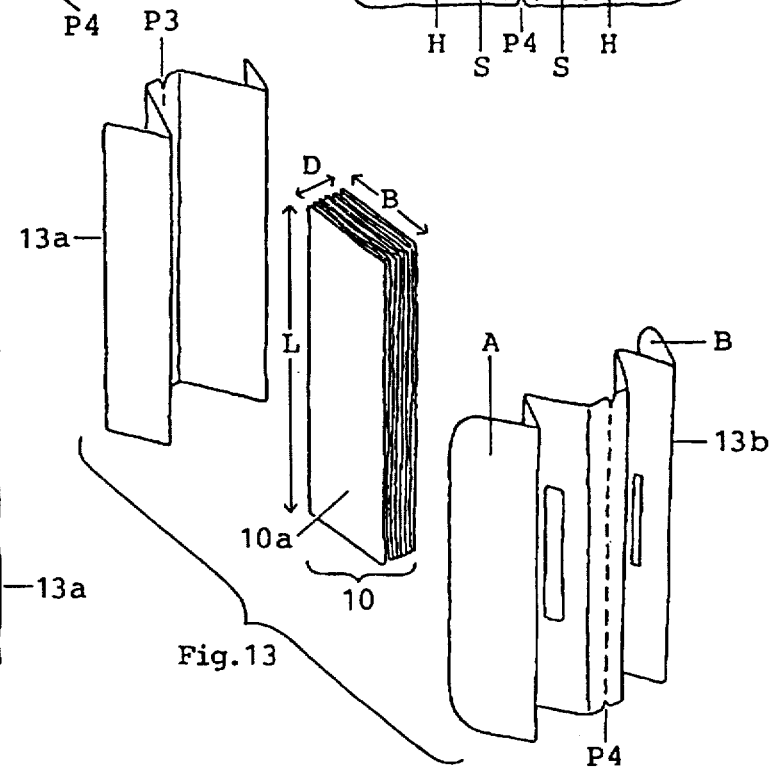
FIG. 13 is a perspective view of the protective layer, according to the modification, before it is cemented together.
Figure 11:
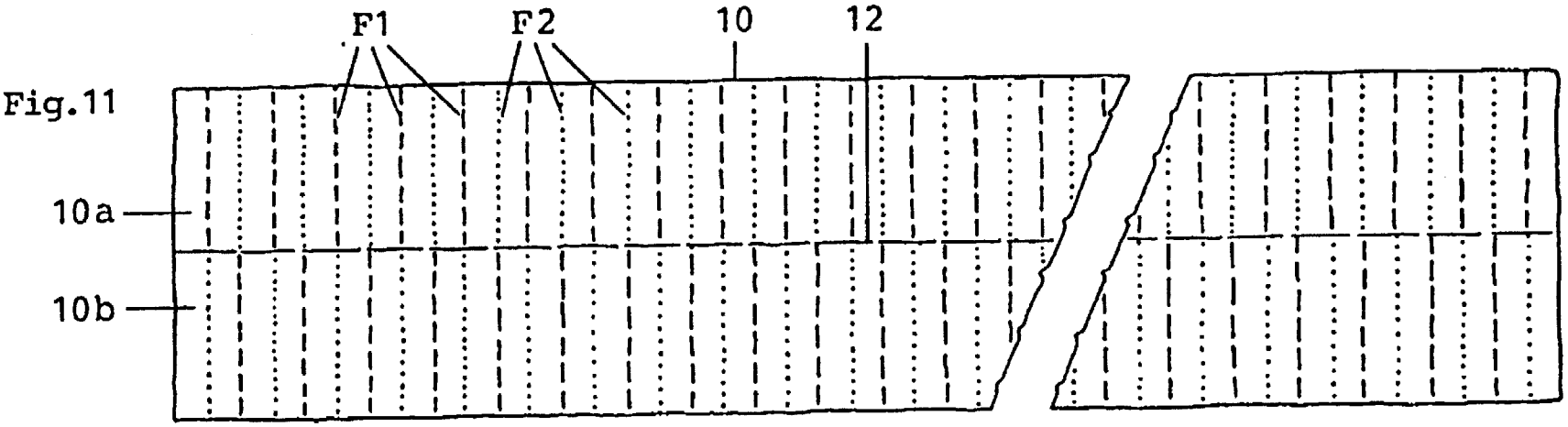
FIG. 11 is a view of the unfolded web of a protective layer, according to the modification.

FIG. 13 depicts the assembled and folded web 10. The large area sides of the package, produced by folding, are formed by means of both ends of the web section 10*a*. It is important that this packet be compact, rectangular and have the same overall thickness and allow compact packaging due to the minimum space requirement. For a web 10 having, for example, a width of 16 cm and a length of 1 meter in the unfolded state, the thickness D of the package is about 4 mm, the length L is 8 cm, and the package width is about 15 mm. The package 13 consists of the packaging sections 13*a* and 13*b* (shown in FIGS. 14 and 15) that are also made of tissue paper and exhibit the folded lines F3 to F7 and perforations P3 and P4. In addition, adhesive strips H and adhesive protective strips S are affixed, according to FIG. 15 to the packaging section 13*b*. The folding of the packaging sections 13*a* and 13*b* is quite clear from FIG. 13. First of all, the section 13*a* is cemented on the folded web 10—that is, on the ends of the web section 10*a*. At this stage the section 13*b* is cemented on the section 13*a* from the opposite side. Both sections envelop in this manner the protective layer and form the package. The free sections of 15*b* form additionally end tabs A and B. FIG. 10 depicts the protective layer, which is packaged for immediate use and has closely abutting flaps or tab members A and B. FIG. 12 depicts the same protective layer with laterally unfolded flaps. To unfold the web 10, the freely abutting tab sections A and B are grasped by hand and pulled in the opposite direction just as in the embodiment described above. To this end, the packaging sections 13*a* and 13*b* are severed along the perforations P3 and P4. The unfolded web 10 is laid on the toilet seat, as described above; and the ends are affixed with the adhesive strips H.

I claim:

1. A protective layer for toilet seats, comprising an oblong web (10), which is to be laid on the surface of the seat and comprises a thin and flexible film, said protective layer being formed by folding said web (10) over about a substantially continuous straight folding line (12) extending in a longitudinal direction of the web to define a seat region (10*a*) on one side of the folding line, said seat region having a shape and size to cover a top portion of the toilet seat around substantially the entire circumference of the toilet seat when the cover is unfolded, and a frontal border (10*b*) on another, opposite side of the folding line, said frontal border having a shape and size to cover an outer peripheral edge of the toilet seat around substantially the entire circumference of the toilet seat when the cover is unfolded, and subsequently fanfolding said web, with the seat region and the frontal border contacting each other, about axes substantially perpendicular to said folding line (12), so as to render a plurality of fanfolded lines in said seat region and said frontal border that intersect said substantially continuous straight folding line, wherein the fanfolded lines in said seat region are directed in an opposite direction from the fanfolded lines in said frontal border.

2. A protective layer, as claimed in claim 1, wherein the web (10) comprises tissue paper.

3. A protective layer as recited in claim 1, wherein said web (10) is housed in an envelope (13).

4. A protective layer, as claimed in claim 3, wherein the envelope (13) comprises two perforated sections (13*a*, 13*b*), which are folded at substantially right angles to the longitudinal direction of the web (10), and wherein one section (13*b*) comprises two opposing tab members (A and B), with which the protective layer is grasped and unfolded.

5. A protective layer, as claimed in claim 4, further comprising adhesive strips (H) and adhesive protective strips (S) on said one section (13*b*), wherein when the tab members (A and B) are pulled apart, the web (10) unfolds and the adhesive strips (H) simultaneously separate from the adhesive protective strips (S).

6. A protective layer as recited in claim 3, wherein said web (10) in a packed condition in said envelope (13) is folded about said straight folding line (12) and collapsed by fanfolding.

7. A protective layer for toilet seats, comprising an oblong web (10), which is to be laid on the surface of the seat and comprises a thin and flexible film, said web (10) comprising a substantially continuous longitudinal folding line (12) which divides said web into a seat region (10*a*) on one side of the folding line, said seat region having a shape and size to cover a portion of the top of the toilet seat around substantially the entire circumference of the toilet seat when the cover is unfolded, and a frontal border (10*b*) on another, opposite side of the folding line, said frontal border having a shape and size to cover an outer peripheral edge of the toilet seat around substantially the entire circumference of the toilet seat when the cover is unfolded, and a plurality of alternating upper and bottom folding lines (F1, F2) in said seat region and in said frontal border, wherein said upper and bottom folding lines intersect said substantially continuous longitudinal folding line, and wherein the upper and bottom folding lines in said seat region are directed in an opposite direction from the upper and bottom folding lines in said frontal border.

8. A protective layer as recited in claim 7, wherein each one of said upper folding lines (F1) in said frontal border meets one of said bottom folding lines (F2) in said seat region at said longitudinal folding line (12), and wherein each one of said bottom folding lines (F2) in said frontal border meets one of said upper folding lines (F1) in said seat region at said longitudinal folding line (12).

9. A protective layer as recited in claim 7, wherein said upper and bottom folding lines extend substantially perpendicular to said longitudinal folding line (12).

10. A protective layer as recited in claim 7, wherein each one of said upper folding lines (F1) in said seat region meets one of said bottom folding lines (F2) in said frontal border at said longitudinal folding line (12), and wherein each one of said bottom folding lines (F2) in said seat region meets one of said upper folding lines (F1) in said frontal border at said longitudinal folding line (12).

* * * * *